US007997256B2

(12) United States Patent
Iwanicki

(10) Patent No.: US 7,997,256 B2
(45) Date of Patent: Aug. 16, 2011

(54) HINGED REMOVEABLE COIL MOUNT

(75) Inventor: David Iwanicki, Niantic, CT (US)

(73) Assignee: Moroso Performance Products, Inc., Guilford, CT (US)

( * ) Notice: Subject to any disclaimer, the term of this patent is extended or adjusted under 35 U.S.C. 154(b) by 404 days.

(21) Appl. No.: 12/343,067

(22) Filed: Dec. 23, 2008

(65) Prior Publication Data

US 2010/0154760 A1 Jun. 24, 2010

(51) Int. Cl.
*F02P 3/02* (2006.01)
*H01F 27/06* (2006.01)

(52) U.S. Cl. ..... 123/635; 123/647; 336/67

(58) Field of Classification Search ..... 123/634, 123/635, 647, 143 C, 195 A, 90.38, 195 C; 336/67, 92, 96
See application file for complete search history.

(56) References Cited

U.S. PATENT DOCUMENTS

| | | | | |
|---|---|---|---|---|
| 4,300,519 | A * | 11/1981 | Isogai et al. | 123/647 |
| 5,003,958 | A * | 4/1991 | Yoneyama et al. | 123/635 |
| 5,152,274 | A * | 10/1992 | Maekawa | 123/635 |
| 6,622,711 | B1 * | 9/2003 | Skinner et al. | 123/634 |
| 6,639,498 | B2 * | 10/2003 | Shimada et al. | 336/96 |
| 6,675,786 | B2 | 1/2004 | Tsunenaga et al. | |
| 6,805,086 | B2 | 10/2004 | Kawai | |
| 6,868,844 | B2 | 3/2005 | Kawai | |
| 7,441,552 | B1 * | 10/2008 | Matsui et al. | 123/634 |
| 2003/0117248 | A1 * | 6/2003 | St. John et al. | 336/67 |
| 2005/0132997 | A1 | 6/2005 | Vargas | |
| 2008/0121199 | A1 | 5/2008 | Harbert | |
| 2009/0241879 | A1 * | 10/2009 | Harbert | 123/90.38 |

FOREIGN PATENT DOCUMENTS

| | | | |
|---|---|---|---|
| JP | 9250437 | A | 9/1997 |
| JP | 2002332945 | A * | 11/2002 |

* cited by examiner

*Primary Examiner* — Willis R Wolfe, Jr.
(74) *Attorney, Agent, or Firm* — St. Onge Steward Johnston & Reens LLC

(57) ABSTRACT

An ignition coil assembly mounted on a valve cover whereby the plurality of coils connected to the ignition coil assembly are individually removable. The ignition coil assembly comprises a base plate and coil bracket that rotateably couple, preferably with a hinging element, allowing for access and removal of individual coils as from the engine or valve cover. The coil bracket is also able to be removed from the base member. A preferred embodiment involves locking the assembly in place with fasteners. A method for manufacture of the ignition coil assembly with the steps of rotateably coupling the base plate and coil bracket. A method for replacing ignition coils from an engine comprising separating the coil bracket from the base plate, removing and replacing individual ignition coils, and locking the coil bracket to the base plate.

20 Claims, 11 Drawing Sheets

HINGED REMOVEABLE COIL MOUNT

FIELD OF THE INVENTION

The present invention relates to a coil mounting assembly for a plurality of coils mounted to an engine or more specifically a valve cover on an engine, and more particularly to a mechanism whereby the plurality of coils are removeable from the valve cover via a mechanism of mounting the plurality of coils on a coil bracket and base plate that provides for easy access and removal of the plurality of coils.

BACKGROUND OF THE INVENTION

The prior art has shown an integrated connector block having a plurality of connectors for supplying power to ignition coils, as disclosed in Japanese Patent Laid-Open Publication No. Hei 9-250437. According to the structure shown in this publication, a plurality of ignition coils are provided for corresponding spark plugs mounted in the engine. These are coaxially coupled to respective coil connecting portions on a lower face of a bar-like, resin connector block member so as to be outwardly fit into the connecting portions.

Meanwhile, to enable the collective mounting of a plurality of ignition coils into their respective plug holes on the engine side, there have been proposed ignition coil assemblies that each hold a plurality of ignition coils fixedly arranged with a predetermined spacing. FIG. 20 shows one such prior art ignition coil assembly 51. A resin base member 53 supports a plurality of ignition coils 52 at locations corresponding to their respective plug holes 5*d* formed in the engine head cover 5. Each ignition coil 52 is fastened to the base member 53 by bolts or is integrally formed therewith by a resin molding process. The ignition coil assembly 51 is mounted on the engine head cover 5 so that the ignition coils 52 are coaxially inserted into the plug holes 5*d*. The ignition coil assembly 51 is then fixed to the engine by mounting bolts 53*c* screwed through bolt holes at lengthwise ends of the base member 53.

The problem with such a prior-art ignition coil assembly 51 is that it involves the cumbersome work of pulling out all the ignition coils 52 together from the plug holes in the engine for the service and replacement of the spark plugs as illustrated in FIG. 21. The ignition coils 52 are respectively connected to the spark plugs 6 by plug caps 52*d*. Pulling out all the ignition coils 52 at once requires a large force that is represented by the strength required for pulling out one ignition coil multiplied by the number of engine cylinders. Thus, the dismounting of the ignition coils 52 is hard work.

Prior art designs have attempted to solve this problem. U.S. Pat. No. 6,868,844 (Kawai) involves an ignition coil assembly that includes a plurality of ignition coils connected to respective spark plugs mounted in respective plug holes formed in the engine. Kawai includes a base member detachably mounted to the engine for supporting the plurality of ignition coils at locations corresponding to the plug holes in the engine, and a removal mechanism for allowing the base member mounted to the engine to be removed from the engine. The base member and coil assembly can be removed for carrying out desired maintenance operations such as service and replacement of the ignition coils. However, even though the plurality of coils can be removed, they sit upon the base member in Kawai. Thus, to remove the ignition coils, the base member has to be detached from the engine, so the assembly can be pulled out and the ignition coils replaced. While this allows for individual ignition coils to be replaced, Kawai does not make the removal of individual ignition coils very easy with regards to the tight spaces and low clearance required in working engines. Further, Kawai does not allow for individual ignition coils to be replaced without removing the base member and coil assembly.

Other prior art designs such as U.S. Pat. No. 6,805,086 (Kawai II) include a base member mounted to an engine with ignition coils being mounted, but adjustable, on the base plate. This allows the manufacturing precision of the plug hole pitch to be eased. U.S. Pat. No. 6,675,786 (Tsunenaga) provides an ignition coil assembly, which allows removable of only a top part of the assembly to facilitate replacement of one or more ignition coils.

United States Patent Publication No. 2008/012199 (Harbert) provides for a coil bracket screwed to a corresponding base member, whereby the ignition coils are secured to the coil bracket. To remove the coils, the coil bracket can be taken off and individual ignition coils can be serviced or replaced, or the entire multi-coil subassembly can be removed by unscrewing the mounting bracket. However, at a minimum, part of the assembly must be removed in order to access the ignition coils and remove them individually.

Thus, in prior art designs, either the base member or coil bracket must be removed in order to individually service and replace coil brackets. It is advantageous to be able to remove individual ignition coils without removing the assembly or part of the assembly from the valve cover. This can add to the speed and efficiency in which individual ignition coils can be replaced, as the assembly does not have to be removed and the replaced back onto the valve cover.

Furthermore, automobiles and other transportation devices typically have tight spaces and low clearance with which to work on the engines. Space and clearance is of the highest priority with regards to these devices and it can be advantageous to add functionality to allow for easy access and removal of ignition coils.

Other advantages that the prior art does not include is the ability to access both sides of the coil bracket, as it can be advantageous, but not necessary, to access both sides of the coil bracket for removal and replacement of the ignition coils. Allowing access to both sides of the coil bracket can increase the speed of removal of the ignition coils. Also allowing access to both sides of the coil bracket allows for the coil bracket to slide off the base member.

Other advantages are to add thermal protection to minimize the transfer of heat from the valve cover to the ignition coils and coil bracket. As the engine radiates heat when it is in operation, it is advantageous to have a mechanism that separates the ignition coils from the valve cover. Heat from the engine will thus be transferred to the coil bracket and ignition coils via convection rather than conduction, resulting in the coil bracket and ignition coils becoming less hot.

What is desired, therefore, is to provide an ignition coil assembly that permits easy removal of individual ignition coils without removing part of or the entire coil assembly from the engine. It is desirable to provide a mechanism whereupon the ignition coils are mounted onto a coil bracket which can rotate, allowing for easy access to the ignition coils for removal and replacement of the ignition coils. It is also desired to be able to remove the coil bracket, so that a plurality of ignition coils mounted on the coil bracket can be removed and replaced. Further, it is desired for a locking mechanism that locks the coil bracket to the base plate, thus locking the ignition coils into place.

SUMMARY OF THE INVENTION

Accordingly, it is an object of the present invention to provide a coil mounting assembly for a plurality of coils mounted to an engine or valve cover, and more particularly to a mechanism whereby the plurality of coils are individually removeable from the engine or valve cover without removing part of or the entire coil assembly from the engine. It is a further object of the invention to provide for ignition coils to be supported by a base plate and coil bracket assembly. It is a further object of this invention to allow for the removal of the coil bracket from the base plate, so that a plurality of ignition coils mounted on the coil bracket can be removed and replaced as a unit. It is a further object of the invention to provide for a locking mechanism to hold the coil bracket into place and allow the ignition coils to engage with the spark plug wire that engages the spark plugs in the engine. Other objects of the invention are to provide for a method for manufacture of a coil assembly of the invention and a method for removing and replacing ignition coils.

These and other objectives are achieved by providing a base plate mounted onto an engine or valve cover, whereby the base plate is supported by the engine or valve cover, and where a coil bracket is rotateably coupled to the base plate, allowing the coil bracket to rotate to an open and closed position. A plurality of ignition coils are mounted onto the coil bracket and individual ignition coils can be removeable from the coil bracket when the coil bracket is in the open position. This allows for easy access and removal of individual ignition coils without removing part of or the entire coil assembly from the engine.

Furthermore, when in an open position, the coil bracket with the plurality of ignition coils mounted thereupon, can be removed from the base plate. This allows the plurality of ignition coils to be removed from the base plate and valve cover.

When the coil bracket is in a closed position, individual ignition coils can be removed as well. The coil bracket is in a closed position when the engine is running, so that the ignition coils function and engage with the wires and consequently the spark plugs in the engine. The ignition coils are typically connected through spark plug wires to respective spark plugs mounted in respective plug holes formed in the cylinder head.

To change its positions, the coil bracket can rotate from the open position to the closed position and vice-versa. In a preferred embodiment of the invention, the coil bracket is rotateably coupled to the base plate using a hinge. This hinging action allows the coil bracket to rotate. The hinging action also allows the coil bracket to slide off the base member in an embodiment of the invention, allowing the plurality of ignition coils to be removed from the base plate and valve cover.

The present invention further comprises a locking mechanism that locks the base plate to the coil bracket when the coil bracket is in a closed position. This locks the coil bracket and ignition coils into position and holds the coil bracket to the base plate.

Furthermore, an additional locking mechanism fixes the base plate to the engine or valve cover on which the base plate is mounted. Both locking mechanisms can comprise fasteners which can be screws or other fastening devices to lock the coil bracket to the base plate, and the base plate to the engine or valve cover, thus securing the ignition coils into position to engage wires and spark plugs.

The invention further comprises standoffs set between the base plate and coil bracket. These standoffs support the coil bracket on the base plate and hold the coil bracket parallel, or substantially parallel, to the base plate, thus stabilizing the ignition coils. Furthermore, standoffs can be also set between the coil bracket and the plurality of ignition coils. This allows for the ignition coils to be set farther from the coil bracket allowing for increased flexibility of the design of the ignition coils. Larger ignition coils and various designs of ignition coils can be used by incorporating the standoffs into the present invention. Furthermore, the standoffs support the ignition coils on the coil bracket and hold the ignition coils parallel, or substantially parallel, to the coil bracket, thus stabilizing the ignition coils.

A preferred embodiment of the invention includes the base plate having at least one cut-out section for access to a valve cover fastener. This can provide for increased access to the valve cover in order to remove the valve cover, if so required. The cut-out section in the base plate also reduces the weight and bulk of the base plate and thus the entire assembly.

Another preferred embodiment of the invention includes the coil bracket having at least one cut-out section to reduce weight and bulk of the coil bracket. This improves the weight of the assembly, making the coil bracket easier to handle. The reduced weight of the assembly is another advantage, as a lighter coil assembly can make for faster automobiles.

Another preferred embodiment of the invention adds thermal protection to minimize the transfer of heat from the valve cover to the ignition coils and coil bracket. As the coil bracket and base plate can be made from materials that dampen the transfer of heat, heat from the engine will thus be transferred to the coil bracket and ignition coils via convection rather than conduction, resulting in the coil bracket and ignition coils becoming less hot.

In order for the heat to transfer to the ignition coils, the heat will have to travel first to the base plate, and then to the coil bracket, and finally end up at the ignition coils. Adding thermal dampening as well as requiring the heat to travel up and through a few elements results in the ignition coils becoming less hot.

The present invention also comprises a method for manufacture of a coil assembly for an engine comprising the steps of introducing a base plate, introducing a coil bracket and rotateably coupling the coil bracket to the base plate, introducing a plurality of coils, and mounting the plurality of coils onto the coil bracket. In a preferred embodiment of this method, the coil bracket is attached to the base plate is via a hinge.

Another embodiment of the present invention further comprises the step of attaching the coil assembly to the valve cover on the engine.

The present invention further comprises a method of replacing ignition coils from an engine comprising removing fastening devices that connect a coil bracket to a base plate, separating the coil bracket from the base plate via a hinging action, so that the coil bracket enters an open position, detaching a number of coils that are mounted to the coil bracket, replacing the coils with new coils, moving the coil bracket into a closed position, whereby in the closed position, the coil bracket is aligned with the base plate, and locking the base plate to the coil bracket.

The method further comprises the step of applying fasteners to lock the base plate to the coil bracket. The method further comprises the step of fixing the base plate to a valve cover. The method also comprises the steps of removing the valve cover and accessing and adjusting the valves.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
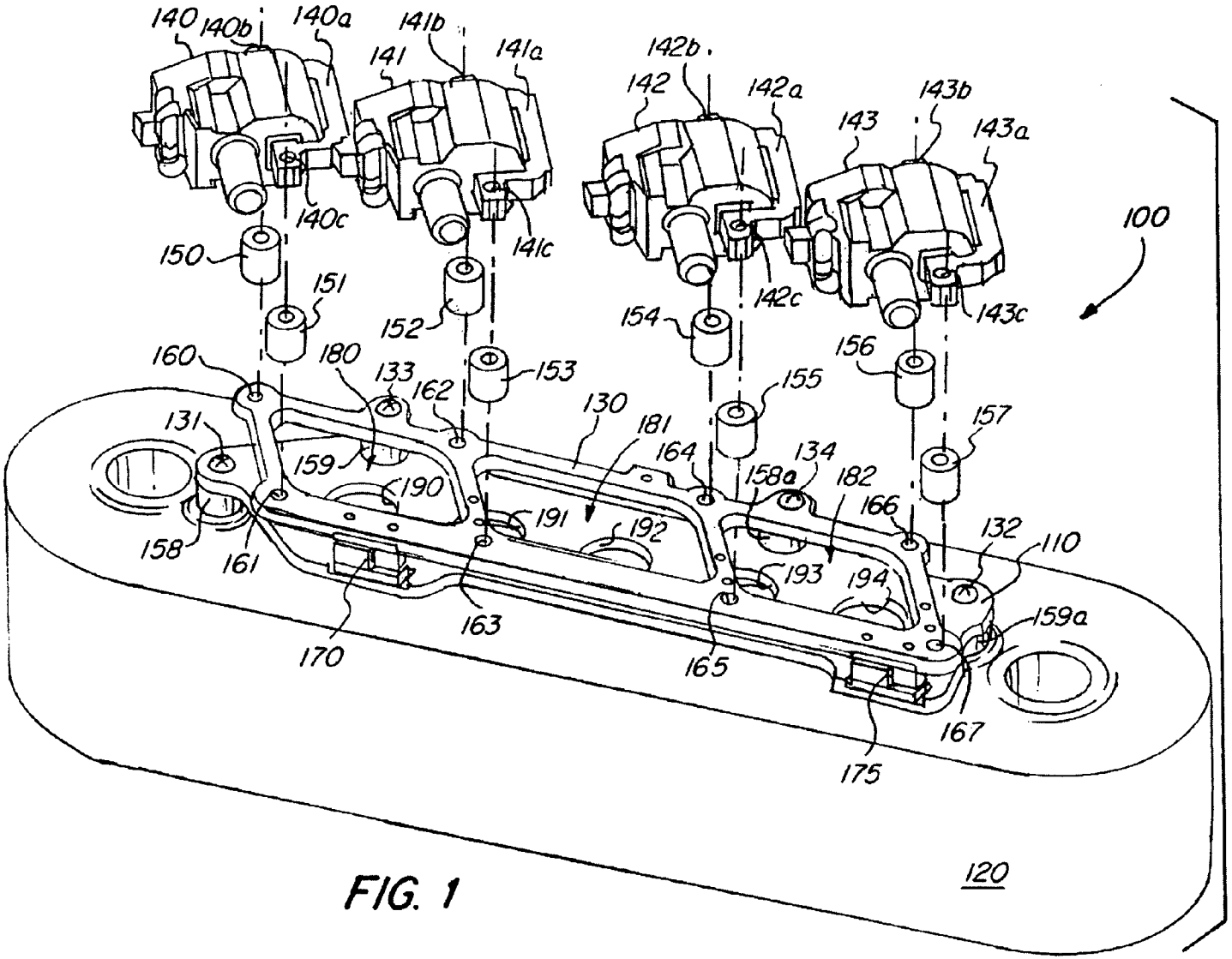
FIG. 1 is a perspective view of the coil assembly with valve cover, base plate, coil bracket, and ignition coils.
Figure 2:
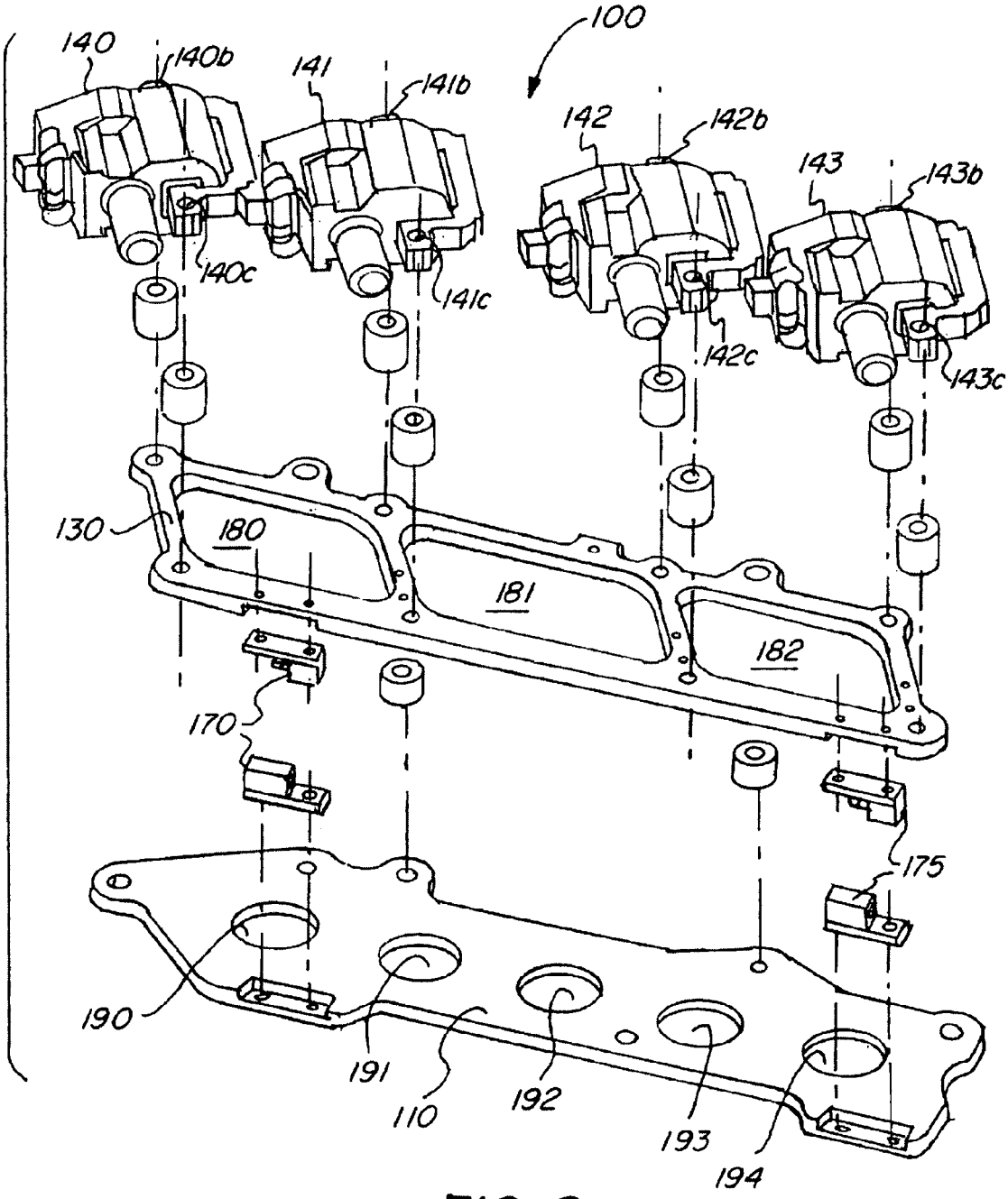
FIG. 2 is view of individual components of the coil assembly shown in FIG. 1.

Referring to FIGS. 1 and 2, an ignition coil assembly 100 for an engine in accordance with the present invention is shown. The ignition coil assembly 100 includes a base plate 110 mounted onto a valve cover 120, wherein said base plate 110 is supported by the valve cover 120. Fasteners 131 and 132 are shown fastening the base plate 110 to the valve cover 120, and two additional fasters are not shown. These fasteners 131 and 132 can be screws or any other such fastening device. A coil bracket 130 is shown rotateably coupled to said base plate 110. The coil bracket 130 is fastened to the base plate 110 via fasteners 133 and 134 and via hinges 170 and 175, which rotateably couple the coil bracket 130 to the base plate 110. The fasteners 133 and 134 can be removed to allow the coil bracket 130 to swing on hinges 170 and 175.

FIG. 1 also shows the plurality of coils 140-143, composed of the plurality of C-shaped attachment elements 140*a*, 141*a*, 142*a*, and 143*a*. These C-shaped attachment elements of coils 140, Ignition coils 140, 141, 142, and 143 are shown aligned with coil bracket 130. Specifically, holes 160 and 161 are aligned with holes 140*b*, and 140*c* of the C-shaped attachment element 140*a*, supporting coil 140 on the coil bracket 130. The other coils 141-143 are supported on the coil bracket in a similar manner. These coils 140-143 are supported by standoffs 150-157, which are shown aligned with the C-shaped attachment elements 140*a*, 141*a*, 142*a*, and 143*a*. Fastening devices (not shown) connect the C-shaped holders 140*a*-143*a* to the coil bracket 130 via the standoffs 150-157. This enables ignition coils 140-143 to be mounted to the coil bracket 130.

Standoffs 158*a* and 159 are shown supporting the coil bracket 130 on the base plate 110. This stabilizes and supports the coil bracket 130 on the base plate 110 when the assembly 100 is in the closed position 1000. Fasteners 131 and 132 are shown aligned with standoffs 158 and 159, which support coil bracket 130 on base plate 110.

FIG. 1 also shows the coil bracket 130 with cut-outs 180-182. As a preferred embodiment of the invention, these cut-outs 180-182 of coil bracket 130 reduce the weight of the coil bracket 130. There is at least one cut-out, but three cut-outs as shown as a preferred design.

In another preferred embodiment of the present invention, the base plate 110 has cut-outs 190-194, which allow access to the valve cover 120. The design shows five cut-outs, but the number of cut-outs can vary. The cut-outs 190-194 reduce the weight of the base plate 110. This is advantageous, as reduced weight of the assembly 100 helps reduce the overall weight of the engine.

With regards to the plurality of coils 140-143, this plurality comprises at least one ignition coil. Four coils 140-143 are shown to be illustrative of the present invention; however, fewer or more ignition coils can also be used. The coils 140-143 can be of various size and shape. Additionally, base plate 110 can be of differing designs and shapes based upon the functionality and alignment upon the valve cover 120. Two designs of base plate 110 are shown in FIGS. 6-12, and FIGS. 13-19 of the present invention. The different designs of the base plate 110 and coil bracket 130 are used for space saving advantages and for alignment purposes with the valve cover 120.

FIG. 1 also shows the ignition coil assembly 100 in the closed position 1000. In the closed position 1000, the plurality of coils 140-143 are engaged with spark plug wires, which are linked to the valve cover 120. The ignition coils 140-143 are supported by the coil bracket 130, which is shown to parallel, or substantially parallel, to the base plate 110 in the closed position.

In this closed position 1000, the ignition coils 140-143 are engaged with the spark plug wires that engage the spark plugs (not shown) in the cylinder head. The spark plugs are typically threaded into a cylinder head which is part of the engine. This is known as a long block assembly in the industry. A locking mechanism is shown whereby fasteners 133 and 134 hold the coil bracket 130 in place. FIG. 2 of the present invention shows an exploded view of coil assembly 100. In this view, the elements of coil assembly 100 are shown aligned with each other, but not linked to each other. Specifically important are the hinges 170 and 175 which rotateably couple the coil bracket 130 to the base plate 110. This allows for the rotating action of the coil bracket 130 which allows for easy removal of the plurality of ignition coils 140-143. Additionally, the hinging and rotating action, allows for easier removal of the entire assembly 100 from the engine block, as the fasteners 131 and 132 can be more easily accessed when the present invention is in the open position 2000.

Figure 3:
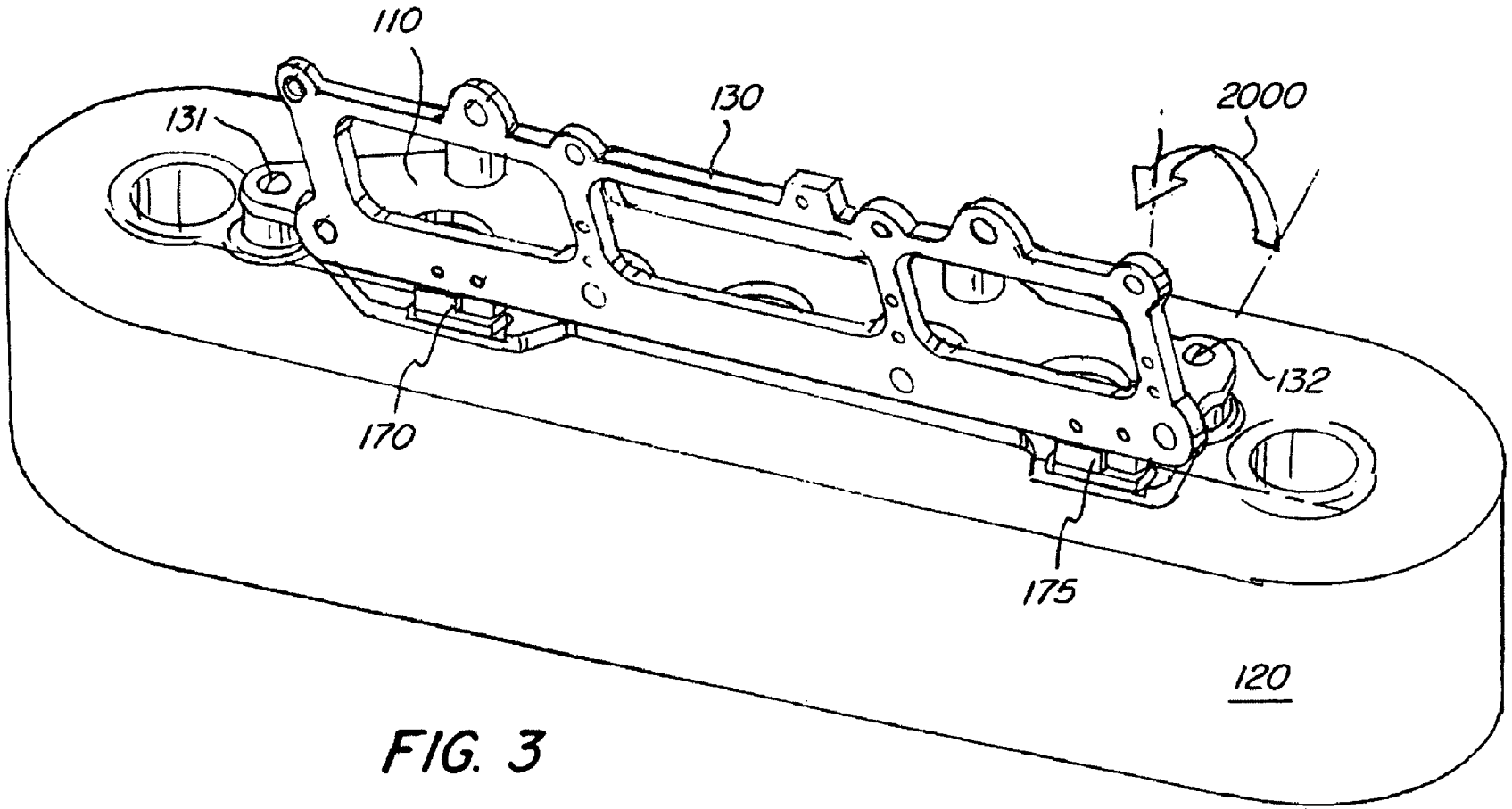
FIG. 3 is a perspective view of the base plate and coil bracket mounted on the valve cover, with the coil assembly in the open position (the coils are not shown here)

FIG. 3 shows another view of the coil assembly 100 in the open position 2000. In FIG. 3, one can clearly see how the assembly mounted on the engine can be opened. The hinging action is represented by the arrow and one can see that the coil bracket 130 rotates away from being parallel, or substantially parallel, to the base plate 110. This is accomplished via hinges 170 and 175.

FIG. 3 does not show the ignition coils 140-143 mounted to the coil bracket 130, as this view would block one from seeing the hinging action of the coil bracket 130. However, FIG. 3 shows that once in the open position (with fasteners 133 and 134 already removed), the coil bracket 130 is able to slide off the base member 110, thus removing the coil bracket from the assembly. This allows for the plurality of ignition coils 140-143 mounted on the coil bracket 130 to be removed from the assembly and valve cover 120.

Figure 4:
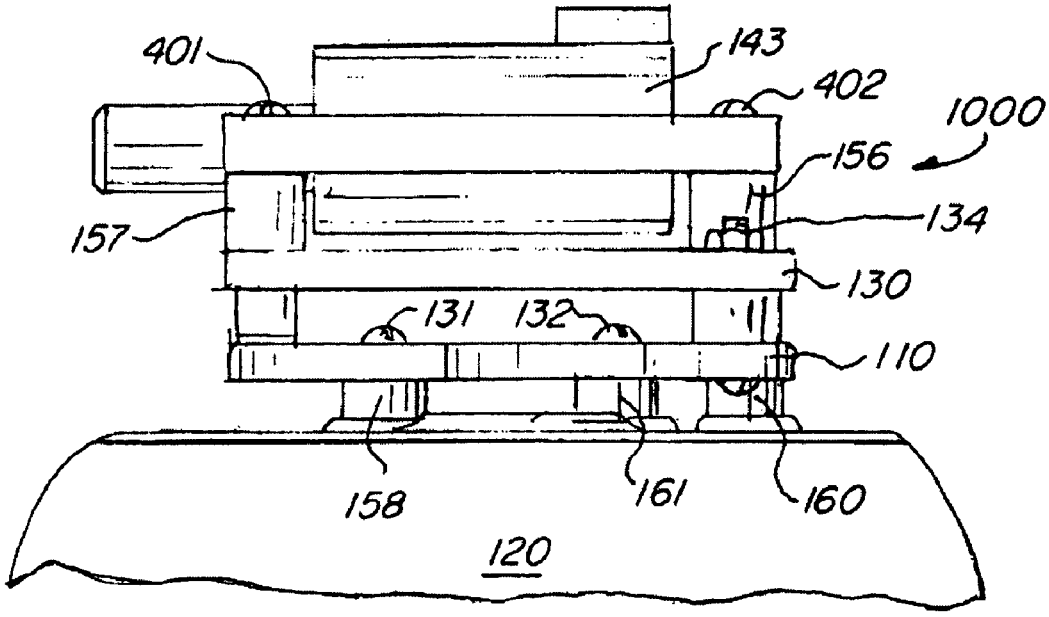
FIG. 4 is a front view of the coil assembly with valve cover, base plate, coil bracket, and plurality of ignition coils in the closed position.

FIG. 4 shows a front view of the coil bracket assembly with the ignition coils 140-143 mounted on the coil bracket 130. Here, base plate 110 is shown mounted on valve cover 120. The coil bracket 130 is shown rotateably coupled to the base plate 110. Furthermore, fasteners are shown whereby the coil assembly is in the closed position 1000. In a preferred embodiment, the fasteners are screws, but other fastening devices can be used. The assembly is closed by the locking mechanism whereby fasteners 131 and 132 lock the base plate 110 onto the valve cover 120, and fasteners 133 and 134 are shown locking the coil bracket 130 to the base plate 110. Fasteners 401 and 402 are shown locking the C-shaped holder and coil 143 to the assembly. The other coils 140-142 are hidden behind coil 143 in this view, and contain corresponding fasteners.

Furthermore, standoffs 158 and 159*a* are shown set between base plate 110 and coil bracket 130 Standoffs 158*a* and 159, as well as two others that are not shown, support the coil bracket 130 on the base plate 110 and hold the coil bracket 130 parallel or substantially parallel to base plate 110, thus stabilizing the ignition coils 140-143 as they are engaged with the valve cover 120. Standoffs 156 and 157 are also shown set between the coil bracket 130 and the ignition coils 143 (whereby standoffs 150-155 and coils 140-142 are hidden from view). This allows for the ignition coils 140-143 to be set farther from the coil bracket 130 allowing for increased flexibility of the design of the ignition coils 140-143.

Figure 5:
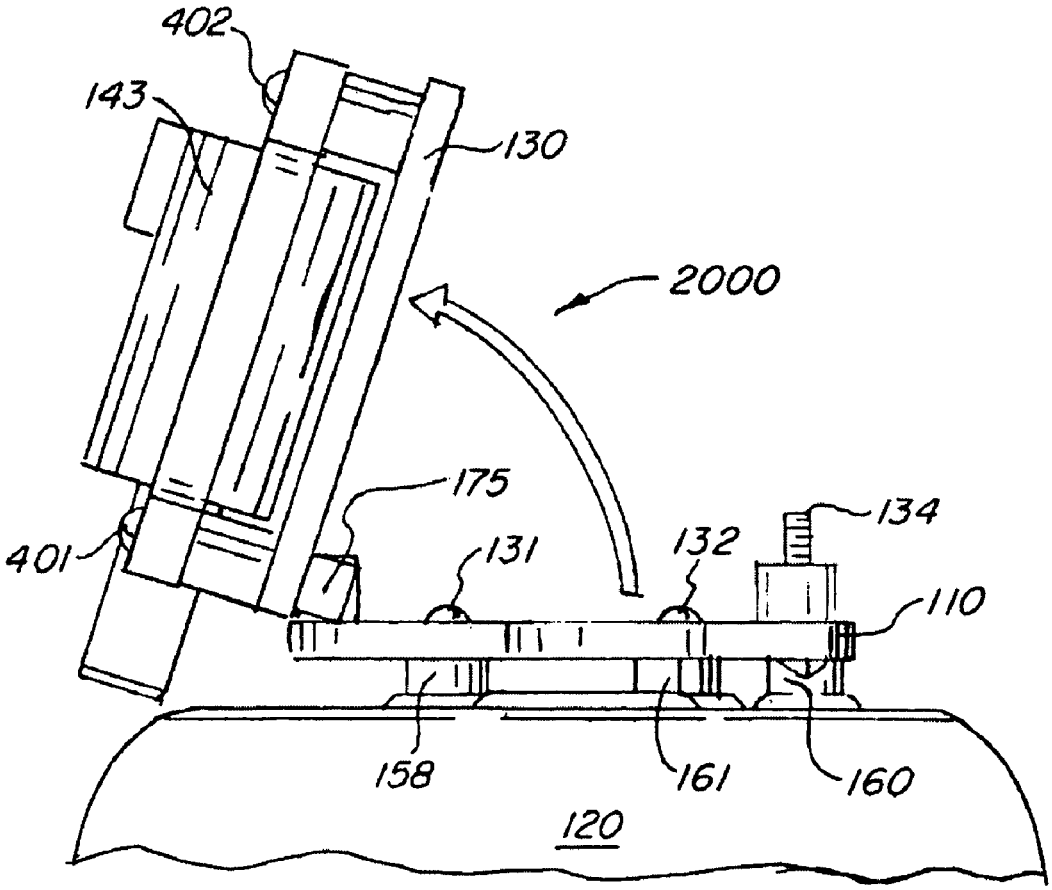
FIG. 5 is a front view of the coil assembly with valve cover, base plate, coil bracket, and plurality of ignition coils in the open position.
Figure 6:
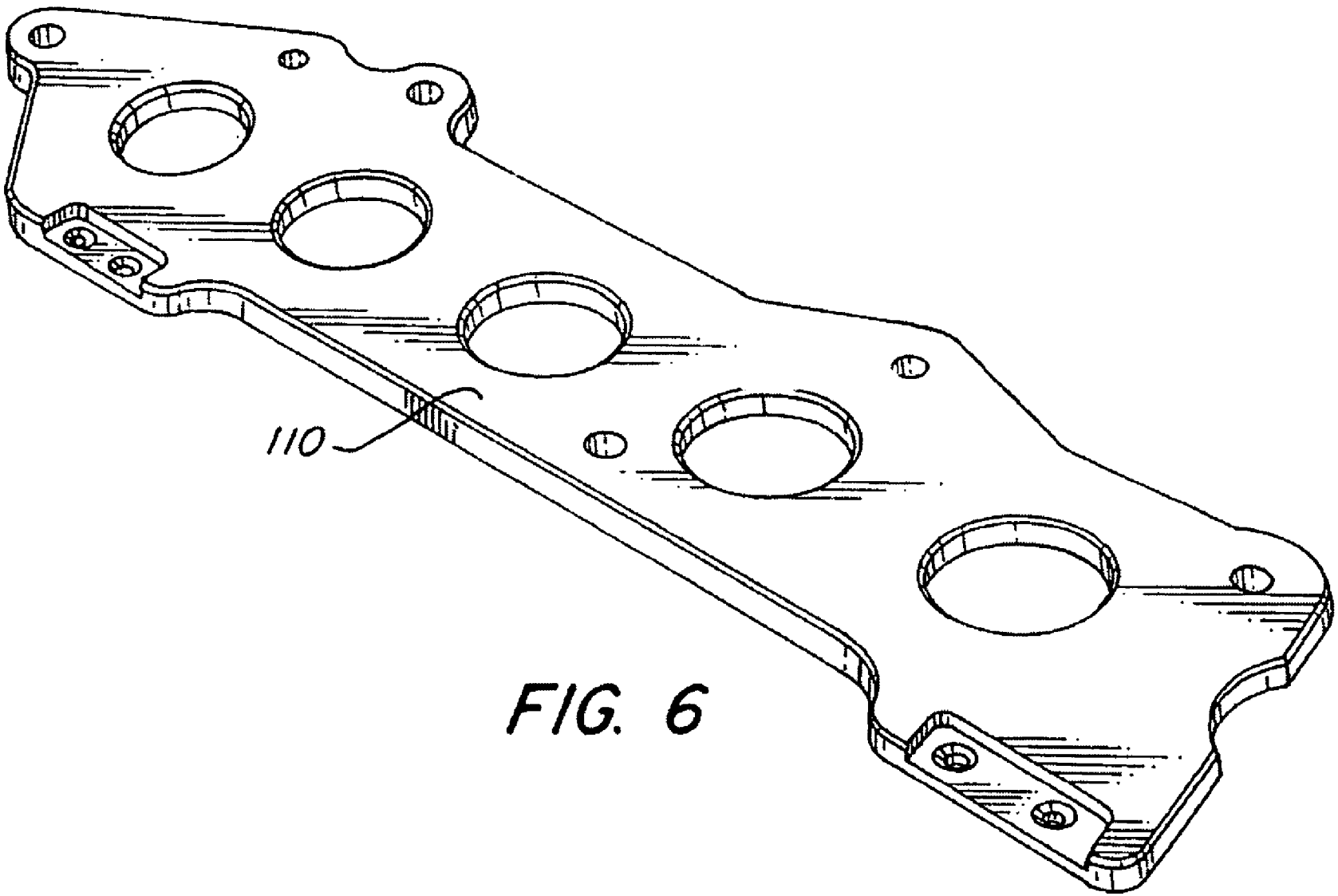
FIG. 6 is an isometric view of a base plate design for the present invention.
Figure 7:
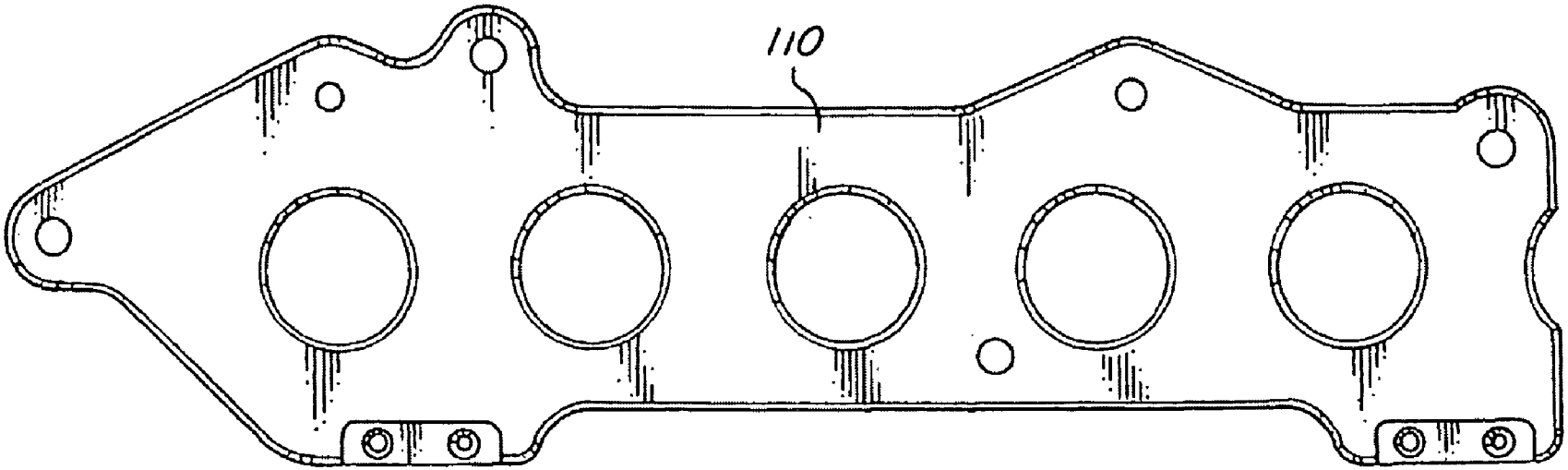
FIG. 7 is a top view of the base plate shown in FIG. 6.
Figure 8:
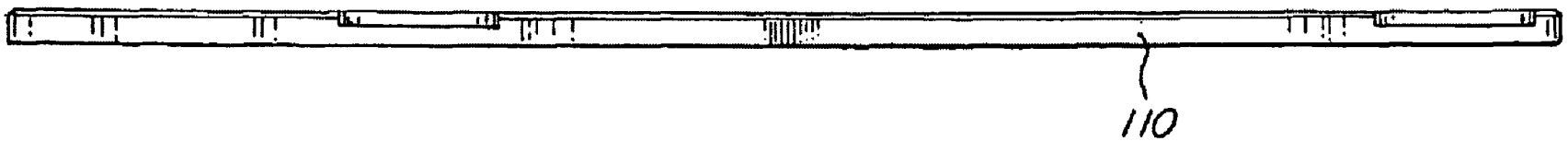
FIG. 8 is a left view of the base plate shown in FIG. 6.
Figure 9:
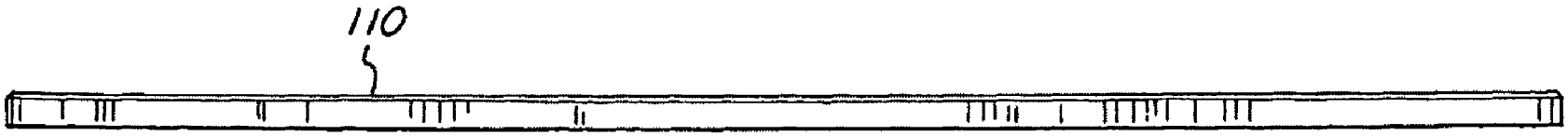
FIG. 9 is a right view of the base plate shown in FIG. 6.
Figure 11:
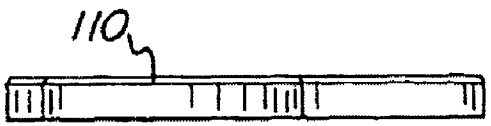
FIG. 11 is a rear view of the base plate shown in FIG. 6.
Figure 10:
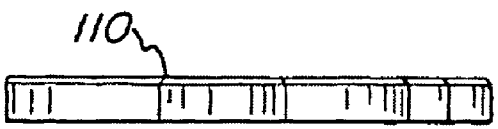
FIG. 10 is a front view of the base plate shown in FIG. 6.
Figure 12:
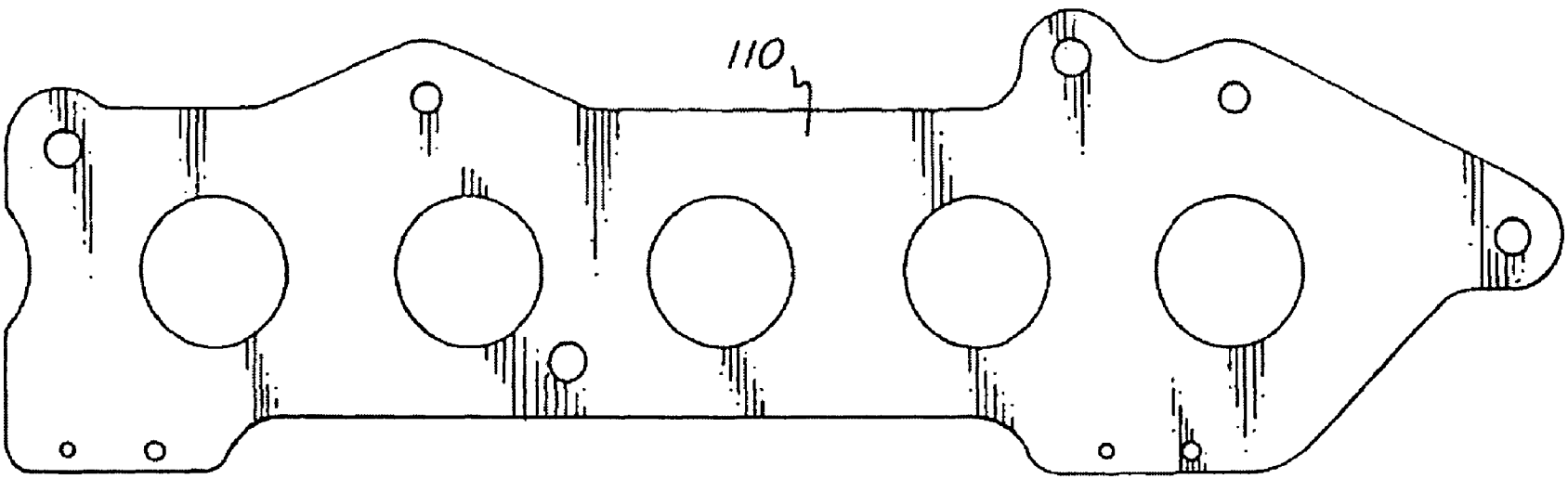
FIG. 12 is a bottom view of the base plate shown in FIG. 6.
Figure 13:
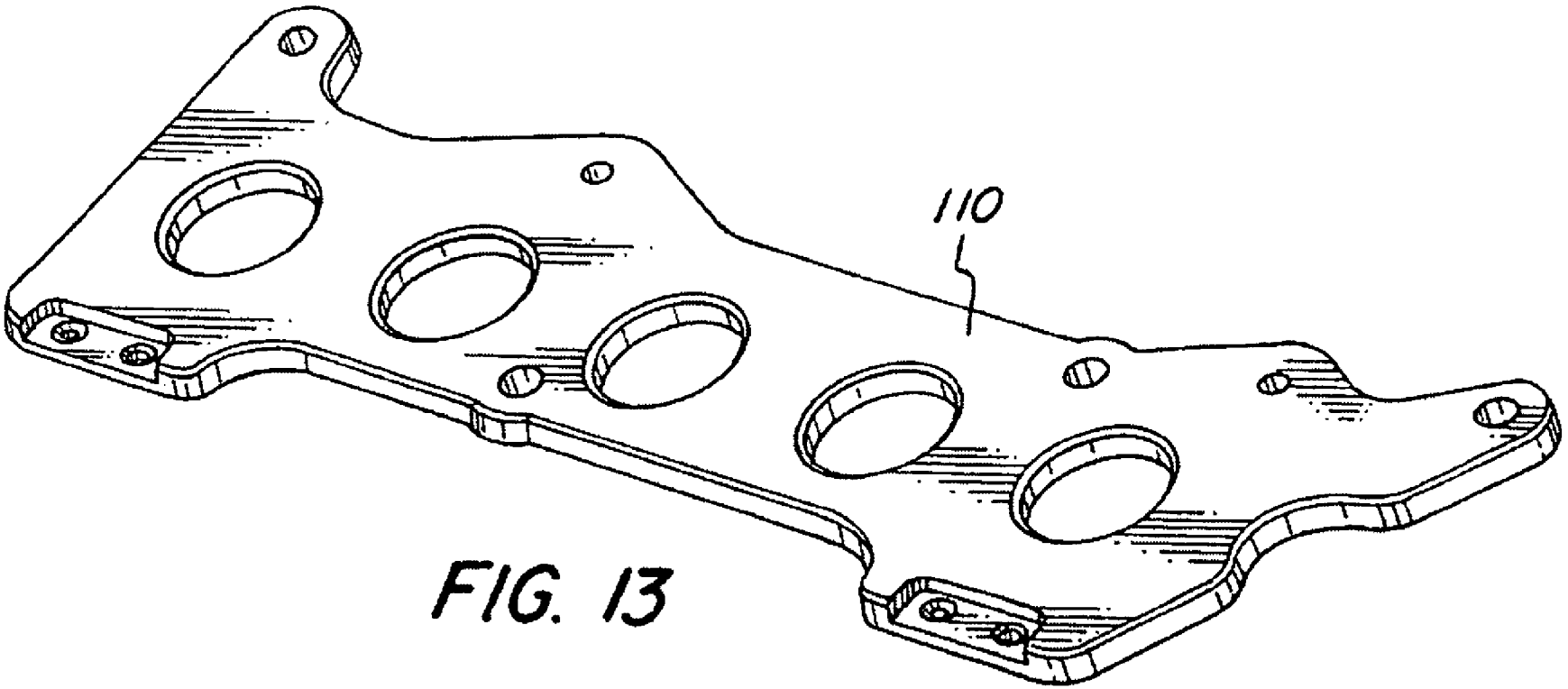
FIG. 13 is an isometric view of a base plate design for the present invention.
Figure 14:
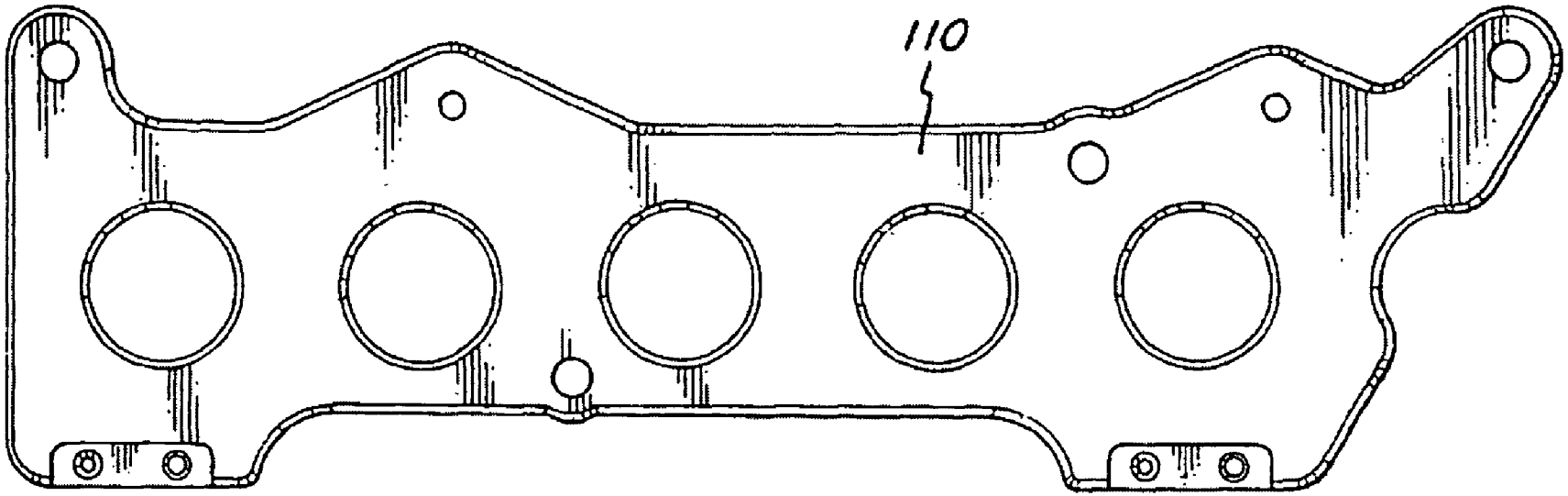
FIG. 14 is a top view of the base plate shown in FIG. 13.
Figure 15:
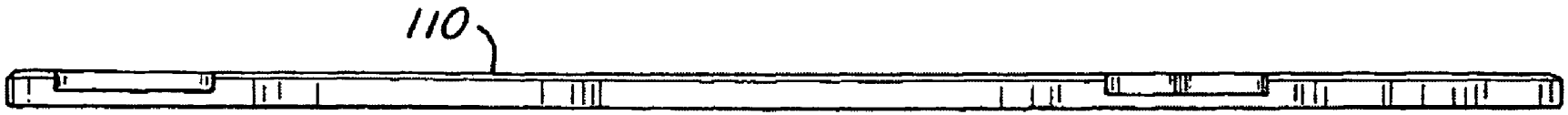
FIG. 15 is a left view of the base plate shown in FIG. 13.
Figure 16:
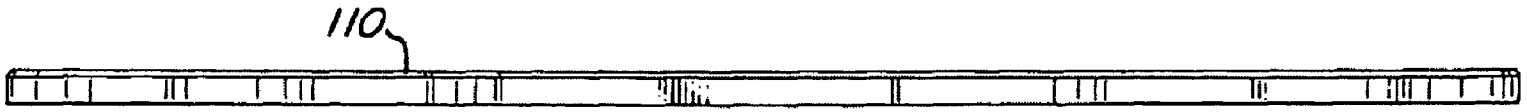
FIG. 16 is a right view of the base plate shown in FIG. 13.
Figure 18:
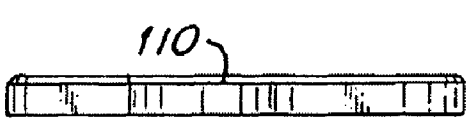
FIG. 18 is a front view of the base plate shown in FIG. 13.
Figure 17:
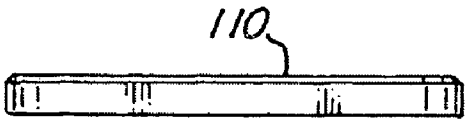
FIG. 17 is a rear view of the base plate shown in FIG. 13.
Figure 19:
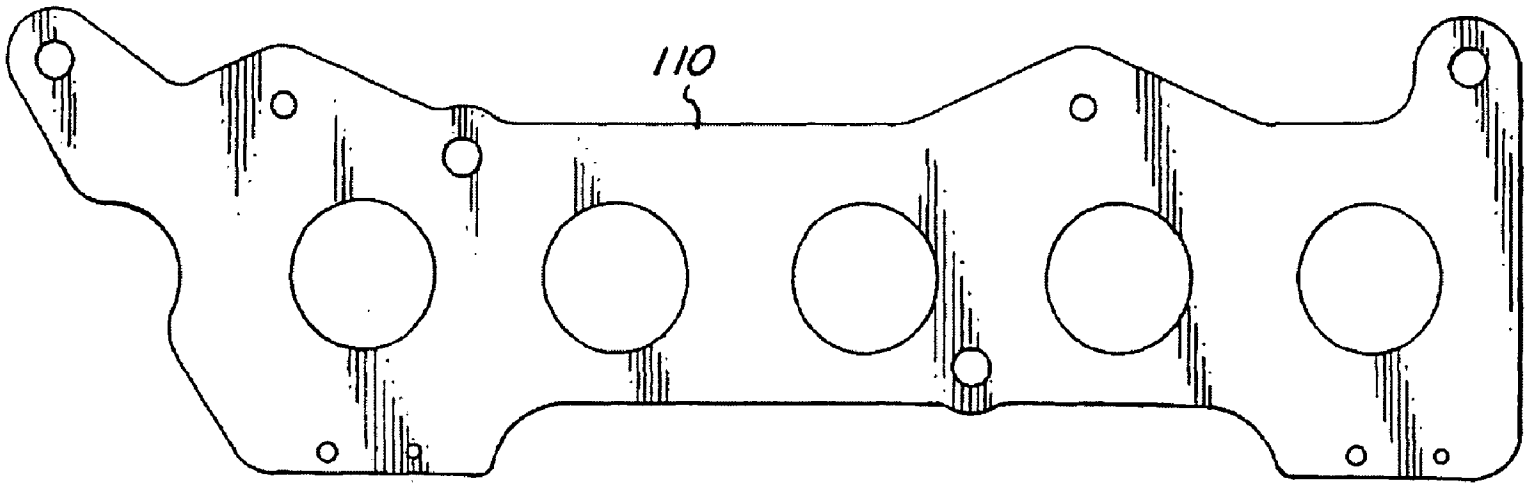
FIG. 19 is a bottom view of the base plate shown in FIG. 13.
Figure 20:
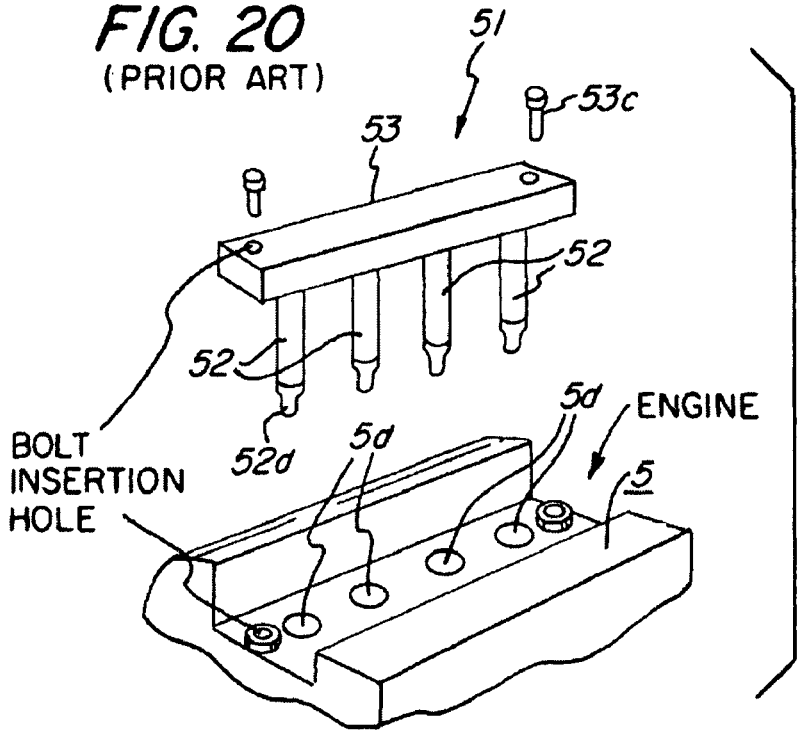
FIG. 20 (PRIOR ART)
FIG. 20 is a perspective view of one prior art ignition assembly.
Figure 21:
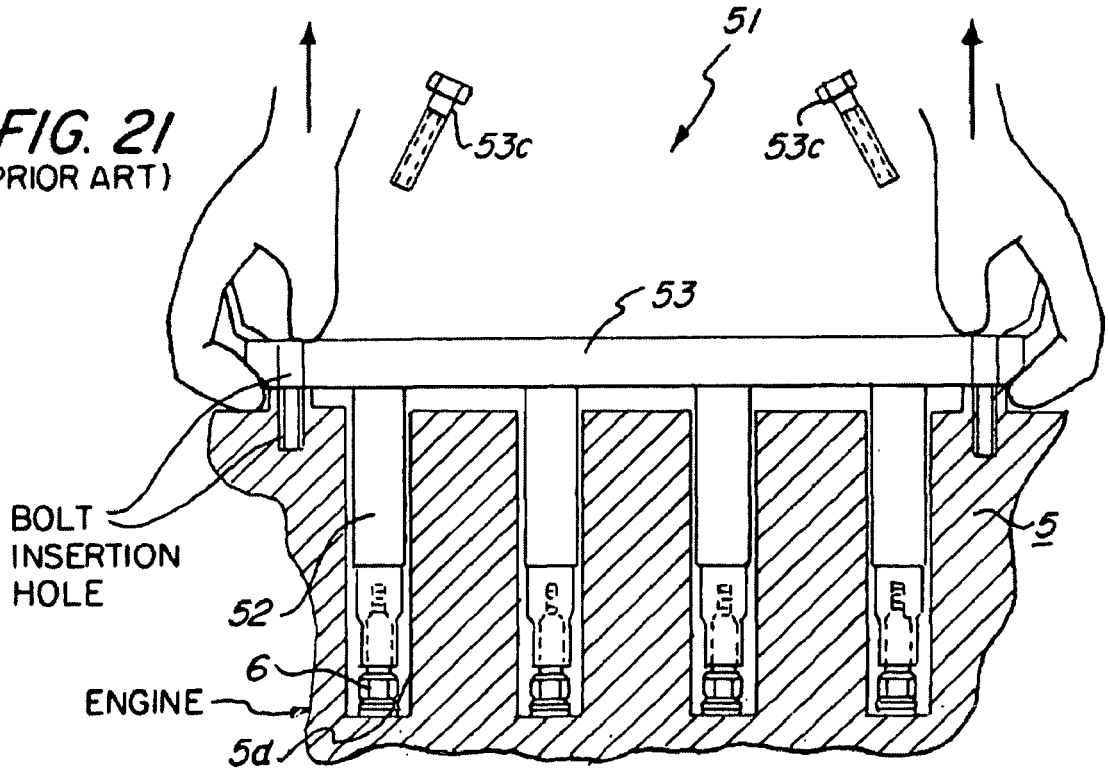
FIG. 21 (PRIOR ART)
FIG. 21 is a diagraph illustrating how the prior art ignition coil assembly of FIG. 20 is removed from the engine.

FIG. 5 shows the open position 2000 of the present invention. Here, the coil assembly 100 is shown whereby base plate 110 is shown rotateably separated from coil bracket 130. Fasteners 131 and 132 are shown attaching the base plate 110 to the valve cover. The coupling mechanism, preferably hinges 170/175, are shown, in order to show how coil bracket 130 is rotateably coupled to base plate 110. The coil bracket 130 can rotate from the open position 2000 to the closed position 1000 and vice-versa.

In the open position 2000, individual ignition coils 140-143 can be removed and replaced. This allows for easy access and removal of individual ignition coils 140-143 without removing part of or the entire coil assembly from the engine. Furthermore, in the open position 2000, access to fasteners 131 and 132 and two others not shown allow removal of the coil bracket from the valve cover 120. This position also allows the coil bracket 130 to slide off the base member 110 in an embodiment of the invention, allowing the plurality of ignition coils 140-143 to be removed from the base plate 110 and valve cover 120.

Further, in FIG. 5, coil bracket 130 can be accessed from above and below the coil bracket to remove the plurality of ignition coils 140-143 as well as to remove the coil bracket 130 from base plate 110. Thus, all or part of the entire assembly can be removed from the valve cover 120, while allowing for ease of doing so. This is especially important when working in tight spaces of an engine where overhead clearance is low. This allows for increased speed of removal of the plurality of ignition coils 140-143.

The present invention also can have thermal protection that minimizes the transfer of heat from the valve cover 120 to the ignition coils 140-143 and coil bracket 130. As the engine radiates heat when it is in operation, the present invention separates the ignition coils 140-143 from the valve cover 120. As the heat from the engine will have to transfer first to the base plate 110, and then to the coil bracket 130, and then to the ignition coils 140-143, the heat will have to travel via convection rather than conduction, resulting in coil bracket and ignition coils becoming less hot. The base plate 110 and/or the coil bracket 130 can be made of a thermal dampening material such as plastic or polymer blend that does not conduct heat very well.

Additionally, the base member 110 and/or the coil bracket 130 can be made of a thermal dampening material, which prevents conduction of heat to reach the ignition coils 140-143. This is advantageous as it allows for the coils to maintain their longevity and be replaced less often.

FIGS. 6-12 show various views of the base plate 110 of the present invention.

FIGS. 13-19 show other various views of a design of base plate 110 of the present invention.

The present invention also comprises a method for manufacture of a coil assembly 100 for an engine comprising the steps of introducing a base plate 110, introducing a coil bracket 130 and rotateably coupling the coil bracket 130 to the base plate 110, introducing a plurality of coils 140-143, and mounting the plurality of coils 140-143 onto the coil bracket 110. In a preferred embodiment of this method, the coil bracket 130 is attached to the base plate 110 via hinges 170/175.

Another embodiment of the present invention further comprises the step of attaching the coil assembly 100 to the valve cover 120 or to a valve cover on the engine.

The present invention further comprises a method of replacing ignition coils 140-143 from an engine comprising removing fastening devices 401, 402, and 403-408 (not shown) that connect a coil bracket 130 to a base plate 110, separating the coil bracket 130 from the base plate 110 via a hinging action, so that said coil bracket enters an open position 2000, detaching a number of ignition coils 140-143 that are mounted to the coil bracket 130, replacing the coils 140-143 with new coils, moving the coil bracket 130 into a closed position 1000, whereby in the closed position 1000, the coil bracket 130 is aligned with the base plate 110, and locking the base plate 110 to said coil bracket 130.

The method further comprises the step of applying fasteners 133 and 134 to lock the base plate 110 to the coil bracket 130. The method further comprises the step of fixing said base plate 110 to a valve cover 120 or to a valve cover by using fasteners 131, 132, and two other fasteners which are not shown. The number of fasteners in the present invention can vary. The present invention also comprises the steps of removing the valve cover and accessing and adjusting the valves.

Other objects of the invention are to provide for a method for manufacture of a coil assembly 100 of the invention and a method for removing and replacing ignition coils 140-143.

While the invention has been specifically described in connection with certain specific embodiments thereof, it is to be understood that this is by way of illustration and not of limitation and that various changes and modifications in form and details can be made thereto, and the scope of the appended claims should be construed as broadly as the prior art will permit.

The description of the invention is merely exemplary in nature, and thus, variations that do not depart from the gist of the invention are intended to be within the scope of the invention. Such variations are not to be regarded as a departure from the spirit and scope of the invention.

What is claimed is:

1. A method for manufacture of a coil assembly for an engine comprising:

introducing a base plate;

introducing a coil bracket and rotateably coupling said coil bracket to said base plate;

introducing a plurality of coils; and mounting said plurality of coils onto said coil bracket.

2. The method for manufacture of the coil assembly of claim 1, whereby the step of rotateably coupling said coil bracket to said base plate is done via a hinge.

3. The method for manufacture of the coil assembly of claim 1, further comprising attaching said coil assembly to the valve cover.

4. A method of replacing ignition coils from an engine comprising:

removing fastening devices that connect a coil bracket to a base plate;

separating said coil bracket from said base plate via a hinging action, so that said coil bracket enters an open position;

detaching a number of coils that are mounted to said coil bracket;

replacing said coils with new coils;

moving said coil bracket into a closed position, whereby in said closed position, said coil bracket is aligned with said base plate; and locking said base plate to said coil bracket.

5. The method of claim 4, further comprising applying fasteners to lock said base plate to said coil bracket.

6. The method of claim 4, further comprising fixing said base plate to a valve cover.

7. A coil mounting assembly for an engine comprising:

a base plate mounted onto a valve cover, wherein said base plate is supported by the valve cover;

a coil bracket rotateably coupled to said base plate, wherein said coil bracket rotates to an open and closed position;

a plurality of coils mounted on said coil bracket, wherein said plurality of coils are removeable from said coil bracket when said coil bracket is in said open position, and wherein when said coil bracket is in said closed position, said plurality of coils are engaged with the engine.

8. The coil assembly of claim 7, wherein in said open position, said coil bracket is removeable from said base member, allowing said plurality of coils to be removeable from said coil bracket.

9. The coil assembly of claim 7, wherein said plurality of coils are connected to wires which link said plurality of coils to spark plugs mounted in respective plug holes formed in the cylinder head.

10. The coil assembly of claim 7, further comprising stand-offs set between said base plate, said coil bracket, and said plurality of coils.

11. The coil assembly of claim 7, wherein said base plate includes at least one cut-out section for access to a valve cover.

12. The coil assembly of claim 7, wherein said coil bracket includes at least one cut-out section to reduce weight and bulk of said coil bracket.

13. The coil assembly of claim 7, wherein said base plate is made of a thermal dampening material.

14. The coil assembly of claim 7, wherein said coil bracket is made of a thermal dampening material.

15. The coil assembly of claim 7, wherein said coil bracket is rotateably coupled to said base plate via a hinge.

16. The coil assembly of claim 15, wherein said hinge allows said coil bracket to rotate from said open to said closed position.

17. The coil assembly of claim 15, further comprising a locking mechanism that locks said base plate to said coil bracket when said coil bracket is in a closed position.

18. The coil assembly of claim 17, wherein said locking mechanism fixes said base plate to a valve cover on which said base plate is mounted thereon.

19. The coil assembly of claim 17, whereby said locking mechanism fixes said base plate to the valve cover on which said base plate is mounted thereon.

20. The coil assembly of claim 19, further comprising fasteners for use in said locking mechanism.

* * * * *